United States Patent [19]

Fineberg

[11] Patent Number: 4,984,969

[45] Date of Patent: Jan. 15, 1991

[54] PLUNGER LIFT TOOL

[75] Inventor: Douglas H. Fineberg, Bowie, Md.

[73] Assignee: Eastport International, Upper Marlboro, Md.

[21] Appl. No.: 404,405

[22] Filed: Sep. 8, 1989

[51] Int. Cl.[5] ..... F04B 47/12

[52] U.S. Cl. ..... 417/58; 417/60

[58] Field of Search ..... 417/56, 57, 58, 60

[56] References Cited

U.S. PATENT DOCUMENTS

| | | | |
|---|---|---|---|
| 1,836,871 | 12/1931 | Ricker . | |
| 1,919,547 | 7/1933 | Fletcher . | |
| 2,237,408 | 4/1941 | Burgher . | |
| 2,267,902 | 12/1941 | Eddins | 417/60 |
| 2,791,181 | 5/1957 | Knox | 417/60 |
| 2,999,545 | 9/1961 | Bigelow | 166/153 |
| 4,070,134 | 1/1978 | Gramling | 417/56 |

*Primary Examiner*—Leonard E. Smith
*Assistant Examiner*—John A. Savio, III
*Attorney, Agent, or Firm*—Foley & Lardner, Schwartz, Jeffery, Schwaab, Mack, Blumenthal & Evans

[57] ABSTRACT

A plunger tool is provided having a nose assembly to slow the descent of the tool into the well, a valve assembly, and a piston cylinder assembly. When the tool is dropped into the well, the gas and liquids in the well flow through restrictions in the nose assembly, thereby braking the fall. The fluid flows along a fingered collet which retains an angled valve. The fluid flows around the opened valve and out of the upper end of the plunger lift tool. The valve is connected to the piston which is exposed to ambient pressure on one side and a predetermined pressure on the other. Thus, the piston is set to close the valve at a predetermined pressure. As the pressure builds up, the piston moves the valve so that a lower portion of the valve is gripped by a detent mechanism, in this case collet fingers. When adequate pressure is built up to unsnap the valve, the piston forces the valve out of the detenting collet fingers and into its seat. Formation pressure from below the seal increases the sealing force. When the valve closes, the collet fingers remain on a shoulder portion of the valve body, thereby allowing the piston to stroke back with minimal resistance. When the tool reaches the top of the well, it pushes the liquid into a sales line. It then strikes the well head and the pressure below the tool is bled off so the tool can be dropped into the well again.

10 Claims, 1 Drawing Sheet

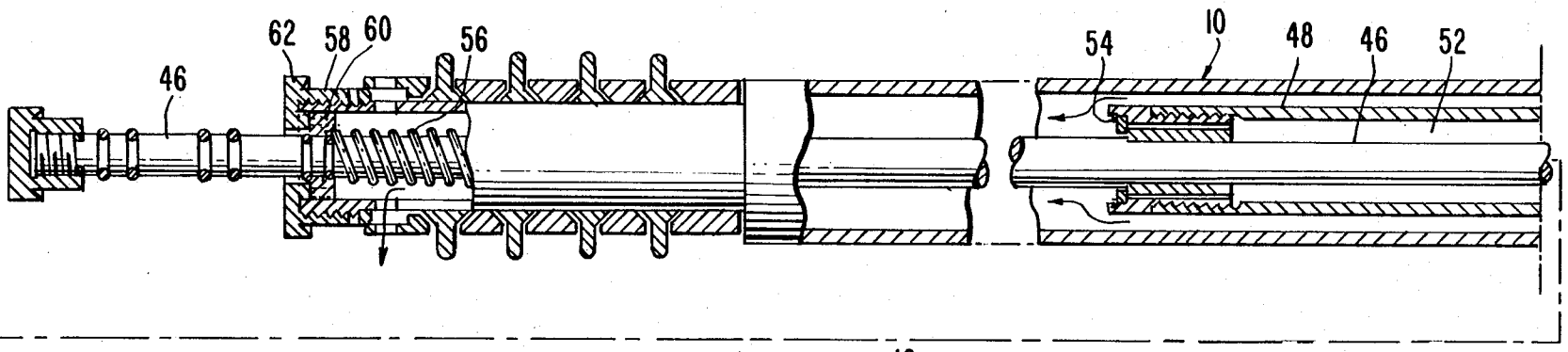
FIG. 1
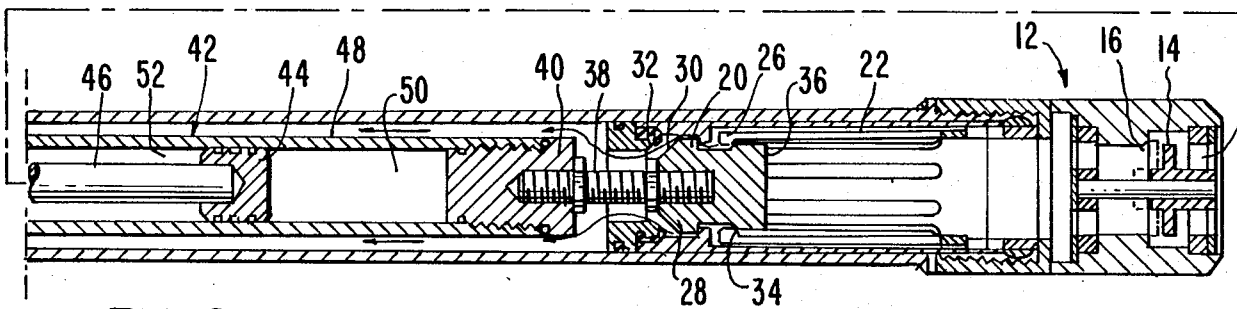
FIG. 2
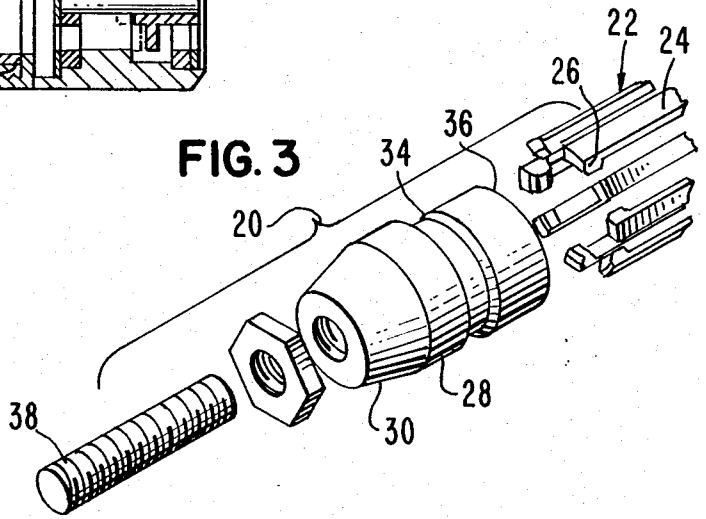
FIG. 3
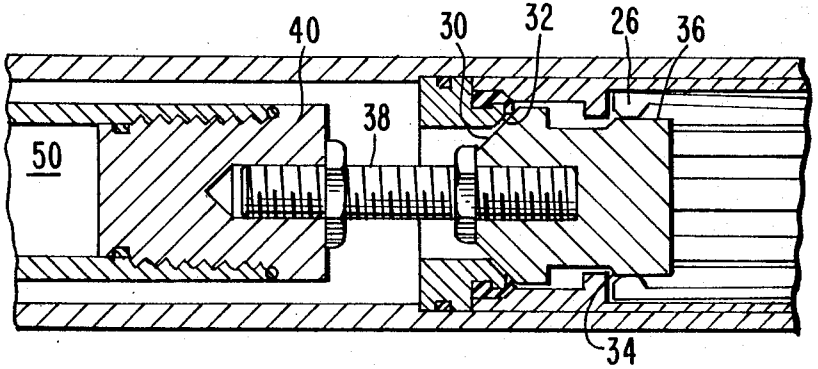

PLUNGER LIFT TOOL

BACKGROUND OF THE INVENTION

1. Field of the Invention

This invention relates to devices for recovering liquids and gas from wells, and more particularly to a plunger lift tool which aids in the recovery of liquids from low volume oil and gas wells.

2. Discussion of the Related Art

In many wells, both oil and gas are produced. Expensive traditional pumping systems are only cost justifiable when the well is flowing freely. Thus, prior to the development of plunger lift tools, many wells were simply abandoned when the flow rate decreased leaving substantial amounts of liquids and gas still in the well.

Known plunger lift tools are designed to inexpensively lift small amounts of liquid from such marginal wells. These tools use formation pressure to lift slugs of liquid to the surface in both deep and shallow wells.

A typical plunger lift tool is disclosed in U.S. Pat. No. 4,070,134. This device comprises a tubular outer shell, through which the gas passes during the descent of the device into the well. A velocity brake having a ball valve and restricting orifice is disposed in a nose portion of the tubular outer shell to slow the descent of the device into the well. When the device has reached a predetermined depth, a piston assembly closes a valve against a valve seat, thereby stopping the flow through the device. The pressure which builds up beneath the device then lifts the tool and the slug of oil above it to the top of the well. U.S. Pat. No. 2,999,545 discloses a well-known pressure relief mechanism. Additionally, U.S. Pat Nos. 1,836,871; 1,919,547; and 2,237,408 disclose various valve assemblies for use with plunger lift tools of this general type.

These prior devices suffer numerous practical disadvantages, however. The valve seat assemblies have proven incapable of developing adequate sealing force, and therefore, the valve would not stay shut. The valve seals also leaked. Additionally, the piston cylinder assembly of U.S. Pat. No. 4,070,134 had gas intrusion due to its position, thereby limiting its effectiveness in closing the ball valve at a predetermined depth. Moreover, the swab cup seals did not provide an adequate seal between the device and the casing.

SUMMARY OF THE INVENTION

Accordingly, it is the object of this invention to provide a plunger lift tool having a valve assembly wherein the valve is held open until sufficient pressure is built up to snap the valve into its seat.

Another object of this invention is to provide a plunger lift tool having a valve assembly with greater sealing force.

Yet another object of this invention is to provide a plunger lift tool having a valve assembly wherein the valve is held onto the seat to yield a greater sealing force.

A further object of this invention is to provide a plunger lift tool having an inverted piston cylinder assembly to prevent gas intrusion.

Still a further object of this invention is to provide a plunger lift tool which can be easily disassembled in the field.

Another object of this invention is to provide a plunger lift tool incorporating a simple swab seal which fits the casing closely.

Yet a further object of this invention is to provide a plunger lift tool having a swab seal which will help center the tool in the casing for even pressure on the seals and guide it through misaligned joints.

According to the present invention, the foregoing and additional objects are obtained by providing a plunger lift tool having a nose assembly to slow the descent of the tool into the well, a valve assembly, and a piston cylinder assembly. When the tool is dropped into the well, the gas in the well flows through restrictions in the nose assembly, thereby braking the fall. The fluid flows along a fingered collet which retains an angled valve. The fluid flows around the opened valve and out of the upper end of the plunger lift tool. The valve is connected to the piston which is exposed to ambient pressure on one side and a predetermined pressure on the other. Thus, the piston is set to close the valve at a predetermined pressure. As the pressure builds up, the piston moves the valve so that a lower portion of the valve is gripped by the detent mechanism, in this case, collet fingers. When adequate pressure is built up to unsnap the valve, the piston forces the valve out of the collet fingers and into its seat. Formation pressure from below the seal increases the sealing force. When the valve closes, the collet fingers remain on a shoulder portion of the valve body, thereby allowing the piston to stroke back with minimal resistance. When the tool reaches the top of the well, it pushes the oil into a sales line. It then strikes the well head, the valve opens, and the pressure below the tool is bled off so the tool can be dropped into the well again.

BRIEF DESCRIPTION OF THE DRAWINGS

Other objects and advantages of this invention will become apparent hereinafter in the specification and accompanying drawings wherein:

FIG. 1 is a partial side sectional view of a plunger lift tool according to the present invention;

FIG. 2 is an enlarged fragmentary sectional detail view showing the valve in closed position; and FIG. 3 is an exploded view of a valve and collet assembly according to the present invention.

DETAILED DESCRIPTION OF THE PREFERRED EMBODIMENTS

As illustrated in FIG. 1, the present invention comprehends an elongated tubular shell 10 which is hollow to allow the passage of liquid. A nose assembly 12 having a velocity reducing means to restrict the flow of gas is disposed at a lower end of the elongated tubular shell 10. The velocity reducing means comprises a longitudinally slidable plate member 14 disposed in a restricting orifice 16. When gas flows through intake ports 18, plate member 14 rises in restricting orifice 16, thus creating a smaller channel for the gas to pass and slowing the descent of the tool into the well.

Referring to FIGS. 1 and 2, a valve assembly 20 is located in the tubular shell above the nose assembly for stopping the flow of well fluids through the plunger lift tool when a predetermined ambient pressure is reached. The valve assembly 20 comprises a radially expandable fingered collet member 22 fixed within the tubular shell. Each finger 24 of the fingered collet member 22 has protruding grippers 26 disposed at the upper end thereof. A slidably disposed valve member 28 has an angled sealing portion 30 which cooperates with a resilient valve seal 32. The valve member 28 has a retaining portion 34 which in a normal position is gripped by protruding grippers 26 of fingered collet member 22. When the valve assembly 20 is in a closed position (FIG. 3), that is, when angled sealing portion 30 abuts the resilient valve seal 32, a shoulder portion 36 abuts the upper surface of protruding grippers 26. Thus, the distance between resilient valve seal 32 and the upper surface of gripping means 26 is greater than the distance between the uppermost point of angled sealing portion 30 and the shoulder portion 34 of the valve member 28. This enables the fingered collet to grab and hold the valve member 28.

While it has been found to be particularly advantageous to use the fingered collet described above, it should be obvious to those skilled in the art that other similar designs that grab and hold the valve assembly could be used. For example, virtually any detent mechanism such as a ball and spring or snap ring arrangement may also be employed without departing from the spirit of the present invention.

The valve member 28 is connected via a connecting rod 38 to actuator connector 40. Actuator connector 40 forms a lower end cap for piston cylinder assembly 42. The piston cylinder assembly includes a piston 44 connected to a rod 46 and sealably, slidably disposed within a piston cylinder housing 48. An atmospheric chamber 50 has a predetermined pressure set relative to sales line pressure. On the other side of piston 44, an hydrostatic pressure chamber 52 has a pressure determined by the depth of the plunger lift tool in the liquid, and the sales line pressure. Ambient pressure chamber 52 communicates with the ambient pressure of the tool via a plurality of pressure ports 54.

Rod 46 extends beyond piston cylinder assembly 42 and out of the plunger lift tool. A pair of locking rings which can be locked into a selected pair of grooves on rod 46 position a stop to select the pressure in the atmospheric chamber. The stop is held in position by compression spring 56, and threaded end cap 58. Additionally, a locking ring 60 holds the stop in place during assembly, and retains it if the threaded cap 58 is removed for servicing the seals 62. In addition to holding the spring stop. The threaded cap 58 also retains the swab seals 60 on the sealing mandrel. The threaded cap also has a shoulder 62 for gripping with an overshot tool (not shown), in the event that the tool gets stuck and the fishing neck gets damaged.

In operation, a stand (not shown) is lowered into the well and secured in the casing, just above the perforation zone. The plunger lift tool is then dropped into the well. As it falls, it compresses the gas below it. The gas flows through the velocity reducing means of nose assembly 12 thus breaking the fall. The descent of the tool is stopped when it lands on the stand.

Liquid flows through the elongated tubular shell via intake ports 18 and around fingered collet member 22 in the direction of the arrows in FIG. 1. As liquid begins to accumulate above the tool, the hydrostatic pressure in the tool will increase. When a sufficient amount of liquid is above the tool, the pressure in hydrostatic pressure chamber 52 will be greater than the predetermined pressure in atmospheric pressure chamber 50. This will cause housing 48 to move upward relative to piston 44. This, in turn, will cause connector actuator 40, connecting rod 38 and valve member 28 to move upward. When adequate pressure is built up, valve member 28 will be forced out of the protruding grippers 26 of fingered collet member 22 and will abut resilient seal 32. Formation pressure from below the valve member 28 increases the sealing force. When the valve member 28 closes, the protruding grippers 26 remain on the shoulder portion 36 of the valve member 28, allowing the piston 44 to stroke back with minimal resistance, once that portion of the cycle is reached. When the formation pressure forces the tool to the top of the well, the fluid is pushed into a sales line. The top of rod 46 then strikes the well head. Since the area of the tool is greater than the area of the valve, the formation pressure forces the tool to continue upward until the valve member 28 is caused to open. The pressure below the tool is then bled off until the tool drops back into the well.

It should become obvious to those skilled in the art that this invention is not limited to the preferred embodiments shown described.

What is claimed is:

1. A plunger lift tool for lifting fluid from wells, comprising:

a tubular member having a nose assembly for admitting well fluids disposed at a lower end thereof;

a valve assembly located in said tubular member above said nose assembly for stopping the flow of said well fluids through the plunger lift tool when a predetermined hydrostatic pressure is reached;

said valve assembly comprising a slidable valve means, means for gripping said slidable valve means, and a valve seat fixed in said tubular casing;

a piston means operatively connected to and located above said valve assembly;

said piston means having a smaller diameter than said tubular member, thereby allowing fluid the flow between the piston means and the tubular member; and a pressure relieving means connected to said piston means and extending beyond the upper end of the cylindrical member;

said means for gripping comprising a radially expandable fingered collet member fixed within said tubular member and having protruding grippers disposed at the upper end of each of said fingers;

said slidable valve means having an angled sealing portion, a protruding retaining portion and a shoulder portion;

said protruding grippers being adapted to grip said protruding retaining portion.

2. The plunger lift tool according to claim 1, wherein: said valve seat is resilient, parallel to said angled sealing portion, and disposed to abut said sealing portion.

3. The plunger lift tool according to claim 2, wherein the distance between said resilient valve seat and said protruding grippers is greater than the distance between the uppermost point of the angled sealing portion and the shoulder portion of said valve means.

4. The plunger lift tool according to claim 1, further comprising a velocity reducing means disposed in said nose assembly to slow the descent of the plunger lift tool into the well.

5. The plunger lift tool according to claim 1, wherein said piston means comprises:

a housing;

a piston member sealably and slidably disposed within said housing, thereby defining an atmospheric chamber on a first side of said piston member, said atmospheric chamber having a predetermined pressure, and an hydrostatic pressure chamber on a second side of said piston member.

6. A plunger lift tool for lifting fluid from wells, comprising:

a tubular member having a nose assembly for admitting well fluids disposed at a lower end thereof;

a valve assembly located in said tubular member above said nose assembly for stopping the flow of said well fluids through the plunger lift tool when a predetermined hydrostatic pressure is reached;

said valve assembly comprising a slidable valve means, means for gripping said slidable valve means, and a valve seat fixed in said tubular member;

a piston means operatively connected to and located above said valve assembly;

said piston means having a smaller diameter than said tubular member, thereby allowing fluid the flow between the piston means and the tubular member; and a pressure relieving means connected to said piston means and extending beyond the upper end of the cylindrical member;

a connecting rod connecting said slidable valve means to said housing;

wherein said piston means comprises:

a housing;

a piston member sealably and slidably disposed within said housing, thereby defining an atmospheric chamber on a first side of said piston member, said atmospheric chamber having a predetermined pressure, and an hydrostatic pressure chamber on a second side of said piston member.

7. The plunger lift tool according to claim 6, wherein said pressure relieving means comprises a rod connected to said piston member.

8. The plunger lift tool according to claim 6, wherein said housing has a plurality of pressure ports defined therein leading from said hydrostatic pressure chamber to an inner portion of said tubular member.

9. The plunger lift tool according to claim 6, wherein the gripping means is a detent mechanism which holds the valve open and which prevents it from closing until an adequate amount of force is applied to the mechanism.

10. The plunger lift tool according to claim 6, wherein said means for gripping comprises a radially expandable fingered collet member fixed within said tubular member and having protruding grippers disposed at the upper end of each of said fingers.

* * * * *